US007506954B2

(12) United States Patent
Huang

(10) Patent No.: US 7,506,954 B2
(45) Date of Patent: Mar. 24, 2009

(54) PRINTER CAPABLE OF CONTROLLING POSITION OF COVERING A NOZZLE OF AN INK CARTRIDGE

(75) Inventor: Shr-How Huang, Taipei (TW)

(73) Assignee: Qisda Corporation, Taoyuan County (TW)

( * ) Notice: Subject to any disclaimer, the term of this patent is extended or adjusted under 35 U.S.C. 154(b) by 433 days.

(21) Appl. No.: 11/307,103

(22) Filed: Jan. 24, 2006

(65) Prior Publication Data

US 2006/0214980 A1 Sep. 28, 2006

(30) Foreign Application Priority Data

Jan. 24, 2005 (TW) ..... 94102067 A

(51) Int. Cl.
*B41J 2/165* (2006.01)
*B41J 2/175* (2006.01)

(52) U.S. Cl. ..... 347/23; 347/29; 347/32; 347/86

(58) Field of Classification Search ..... 347/22–35, 347/86
See application file for complete search history.

(56) References Cited

U.S. PATENT DOCUMENTS 5,610,635 A * 3/1997 Murray et al. ..... 347/7
6,126,265 A * 10/2000 Childers et al. ..... 347/23
6,142,600 A * 11/2000 Takahashi et al. ..... 347/23

* cited by examiner

*Primary Examiner*—Shih-Wen Hsieh

(57) ABSTRACT

A printer capable of controlling position of covering a nozzle of an ink cartridge includes a housing, a shaft installed inside the housing, a carriage installed on the shaft in a sliding manner for carrying a first ink cartridge, a first cover for covering a nozzle of the first ink cartridge, and a means for determining type of the first ink cartridge and controlling stopping position of the carriage and the first cover after the first cover covers the nozzle of the first ink cartridge according to the type of the first ink cartridge.

21 Claims, 11 Drawing Sheets

PRINTER CAPABLE OF CONTROLLING POSITION OF COVERING A NOZZLE OF AN INK CARTRIDGE

BACKGROUND OF THE INVENTION

1. Field of the Invention

The present invention relates to a printer capable of controlling position of covering a nozzle of an ink cartridge, more particularly, to a printer capable of controlling a position of covering a nozzle of an ink cartridge to determine whether or not to pump ink out of the nozzle of the ink cartridge.

2. Description of the Prior Art

Inkjet printing system is now being commonly utilized in all types of fax machines, printers, photocopiers and other office equipment. The ink jet printing system includes a print head capping device for ensuring that the print head functions properly. The print head capping device will cover the print head to prevent the ink in the nozzle from drying up and congesting the print head while the ink jet system is not active.

At the moment, the ink jet printing system on the market usually installs an additional pump mechanism at an end of the print head capping device. The main function of the additional pump mechanism is to refine the condition of the dry nozzle before performing a print out such that it will not affect the quality of the print out. Usually the pump mechanism makes only a single journey, which means that when a cover covers the nozzle of the ink cartridge, the carriage of the ink cartridge and the cover stop at a fixed position, and the pump mechanism will stop at the fixed position to pump ink out of the nozzle of the ink cartridge. If the ink jet printing system is set to support six-color printing there will be a problem due to the nature of the black ink pigment, therefore the designer does not want the black ink to be pumped by the pump mechanism so as to prevent the black ink from drying up in the pump mechanism tube resulting in a congestion. Additionally, as observed from lab experimentation, when the print head capping device is opened and the ink cartridge is left unutilized for a month, the ink that usually dries up first is the color ink and not the black ink. Therefore the ink jet printing system in the market is not equipped with a design of selectively pumping out only the color ink and this results in a reduction in the quality of an image printout.

SUMMARY OF THE INVENTION

The claimed invention relates to a printer capable of controlling position of covering a nozzle of an ink cartridge to determine whether or not to pump ink out of the nozzle of the ink cartridge to solve the problem mentioned above.

One embodiment of the claimed invention is a printer capable of controlling position of and covering a nozzle of an ink cartridge, the printer comprising: a housing; a shaft, installed in the housing; a carriage, installed on the shaft in a sliding manner, for carrying a first ink cartridge; a first cover for covering the nozzle of the first ink cartridge; and a means for determining type of the first ink cartridge and controlling stopping position of the carriage and the first cover after the first cover covers the nozzle of the first ink cartridge according to the type of the first ink cartridge.

Another embodiment of the claimed invention is a method of controlling position of and covering a nozzle of an ink cartridge, the method comprising: determining type of a first ink cartridge; and controlling stopping position of the carriage of the first ink cartridge and the first cover after the first cover covers the nozzle of the first ink cartridge according to the type of the first ink cartridge.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
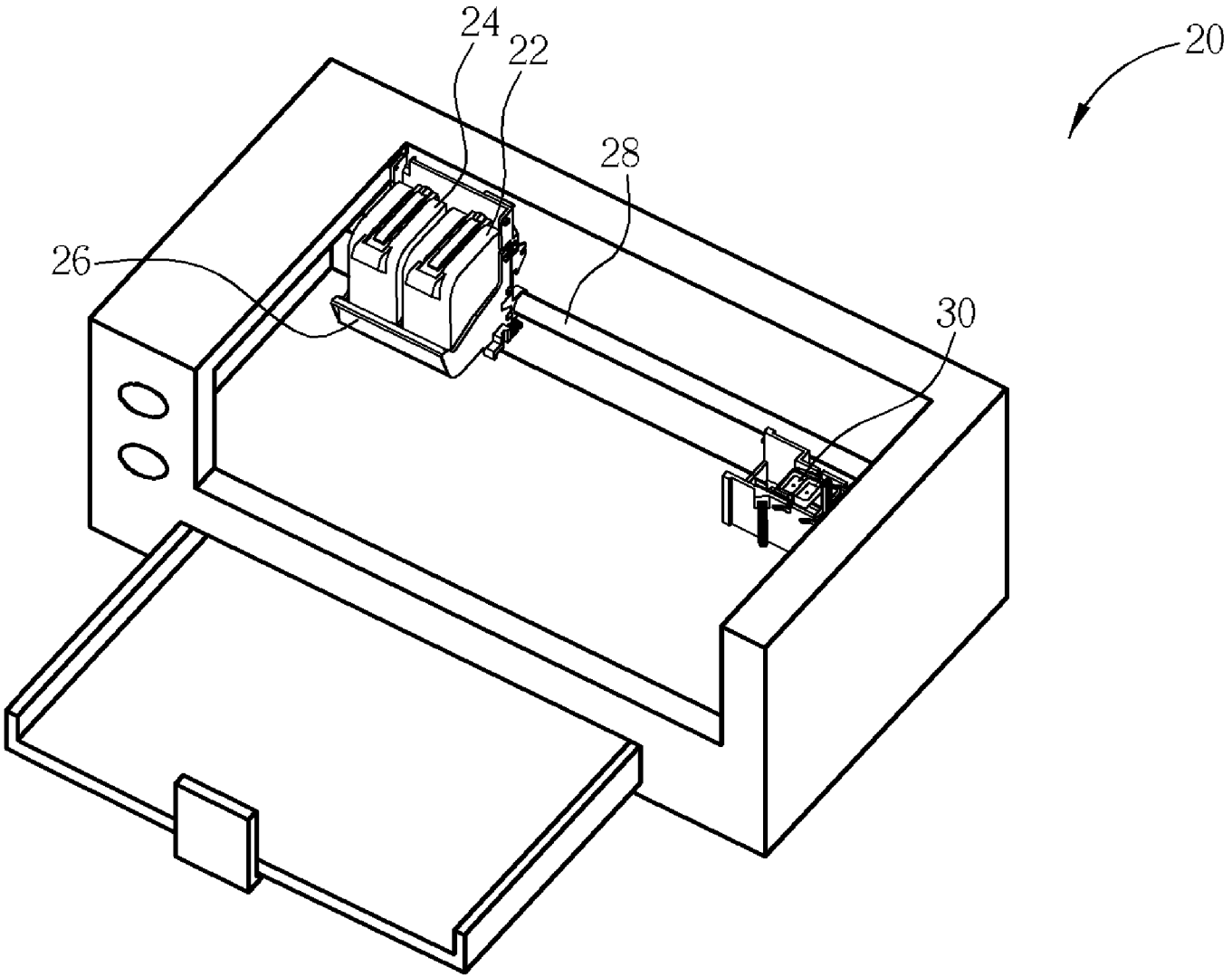
FIG. 1 illustrates a transparent diagram of a printer according to the present invention.

Please refer to FIG. 1. FIG. 1 illustrates a transparent diagram of a printer according to the present invention. The printer 20 can be a printer that supports six-color printing. The printer 20 comprises a first ink cartridge 22 and a second ink cartridge 24 each installed on a carriage 26. The first ink cartridge 22 can be a three-color ink cartridge of light cyan, light magenta and black, or a black ink cartridge. The second ink cartridge 24 can be a three-color ink cartridge of cyan, yellow and magenta. The carriage 26 is capable of moving the first ink cartridge and the second ink cartridge on a shaft 28. When the first ink cartridge 22 and the second ink cartridge 24 are moved by the carriage 24 on the shaft 28, a print head located at the bottom of the ink cartridge (not shown in the diagram) will perform the print out. The print head comprises at least one nozzle to spray ink onto a document during the process of generating a print out. The printer further comprises a capping device 30 fixed on an end of the shaft 28. After the first ink cartridge 22 and the second ink cartridge 24 complete a print out, the carriage 26 will carry the first ink cartridge and the second ink cartridge 24 into the capping device to perform a capping process.

Figure 2:
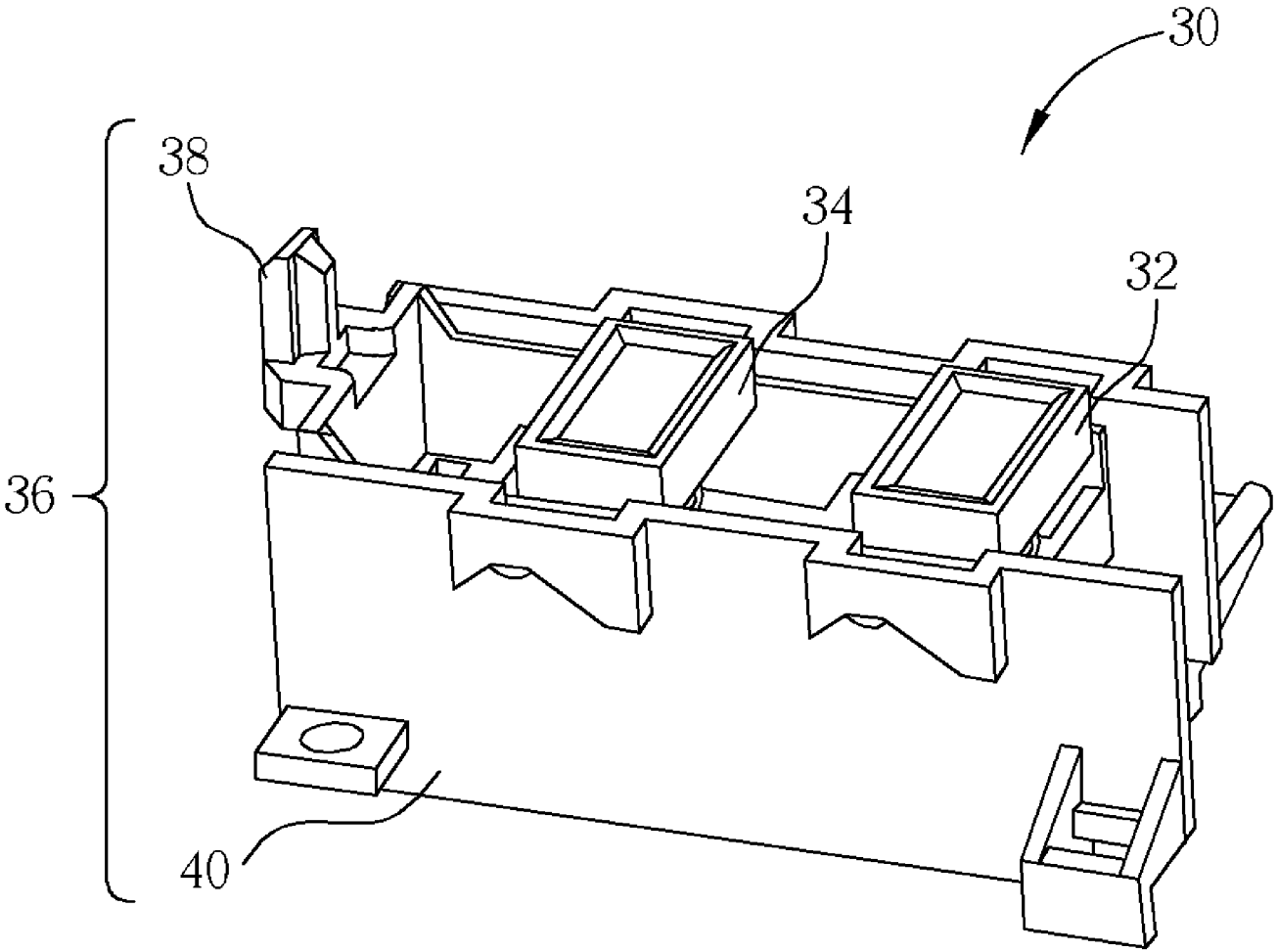
FIG. 2 illustrates an exterior view diagram of the capping device.

Please refer to FIG. 1 and FIG. 2. FIG. 2 illustrates an exterior view diagram of the capping device 30. The capping device 30 comprises a first cover 32 and a second cover 34 and a support structure 36 further comprises a sled 38 and a fixed mount 40. The sled 38 acts as the carriage of the first cover 32 and the second cover 34, and the fixed mount 40, installed on the shaft 28 in a sliding manner, for carrying the sled 38 and being slid and moved by a means of the printer for moving the carriage 26 on the shaft, and it is also capable of being slid upwards and downwards on the capping device 30 by the means. When the carriage 26 is moving towards the capping device 30, the sled 38 will also be carried up, at the same time the first cover 32 and the second cover 34 will also be moved upwards to cover the nozzle of the first ink cartridge 22 and the second ink cartridge 24.

Figure 3:
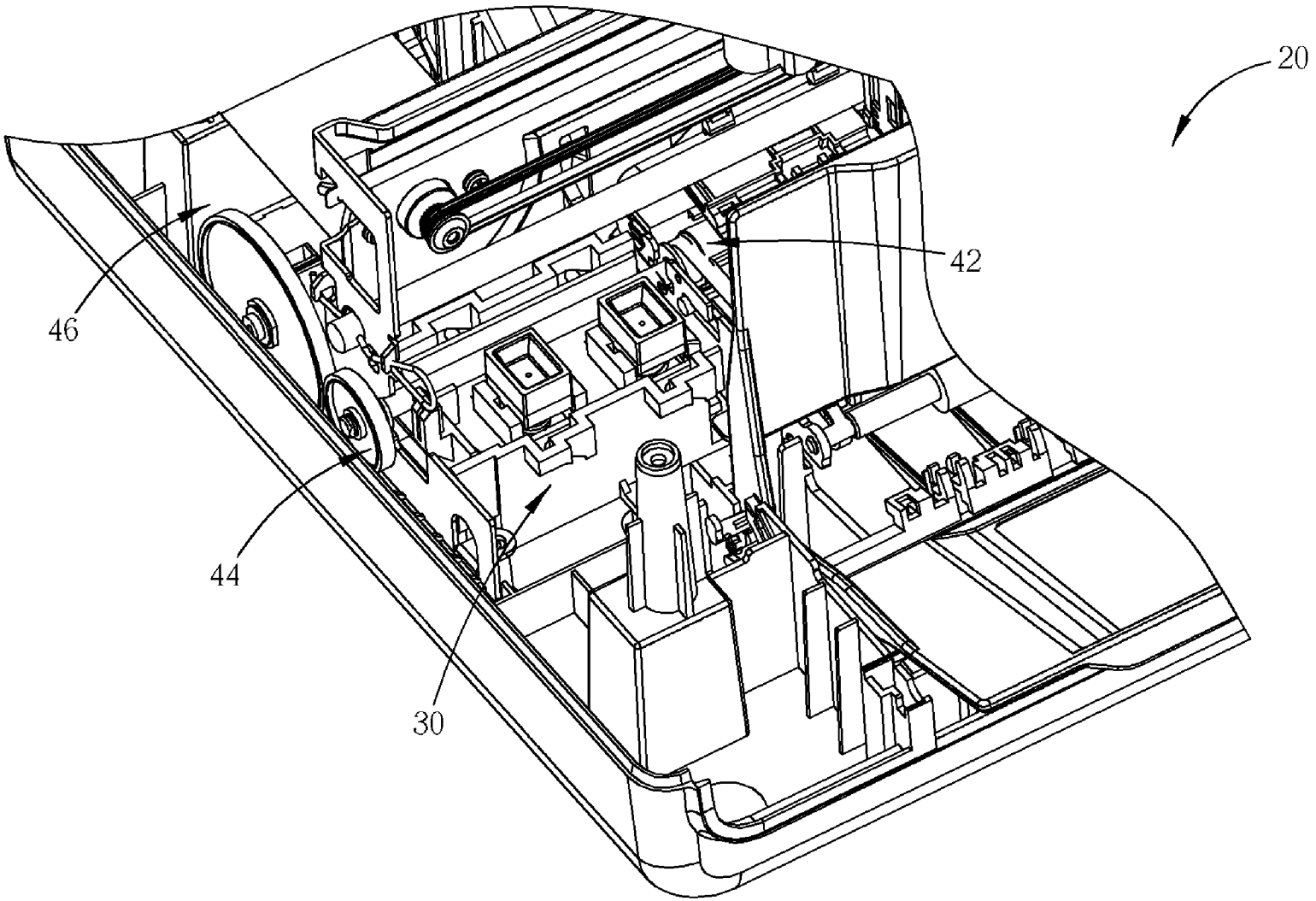
FIG. 3 illustrates an internal architecture diagram of the printer.
Figure 4:
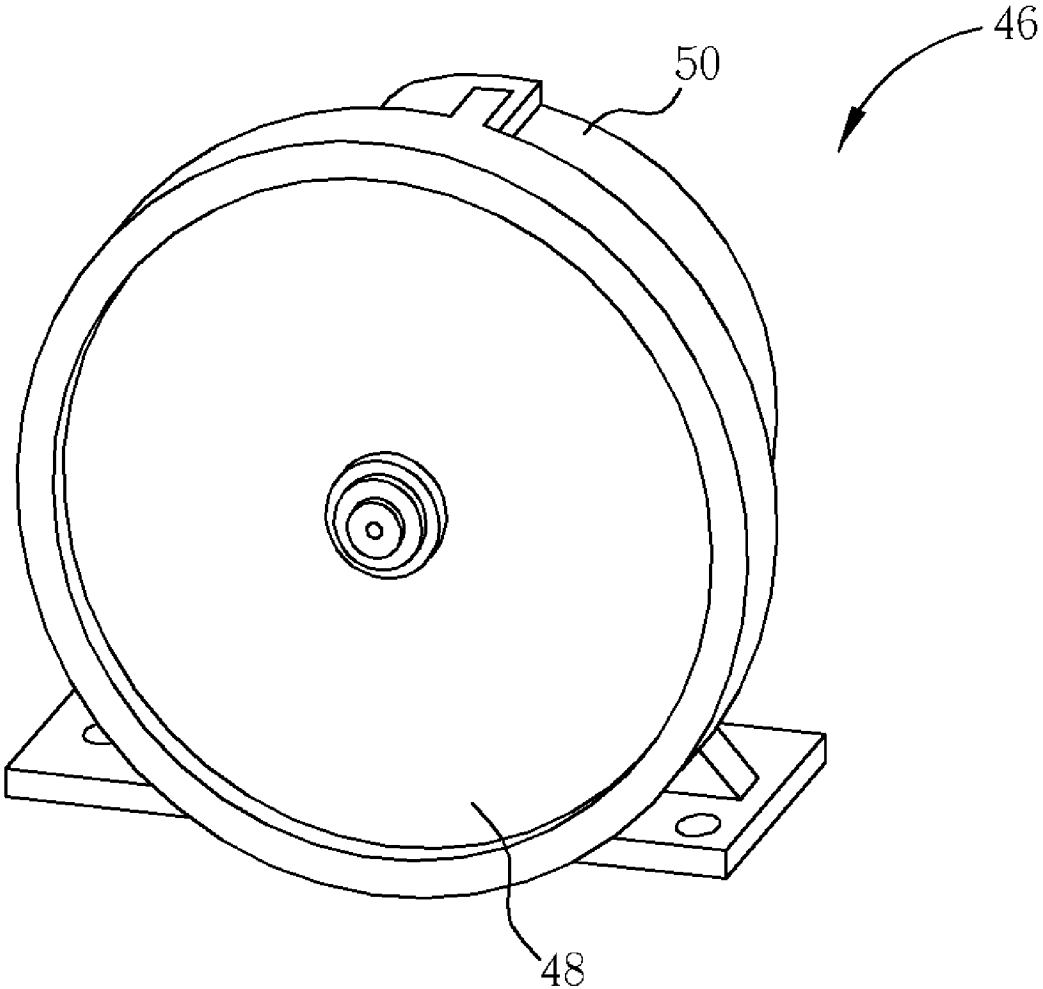
FIG. 4 illustrates an exterior view diagram of a pump device of a printer.
Figure 5:
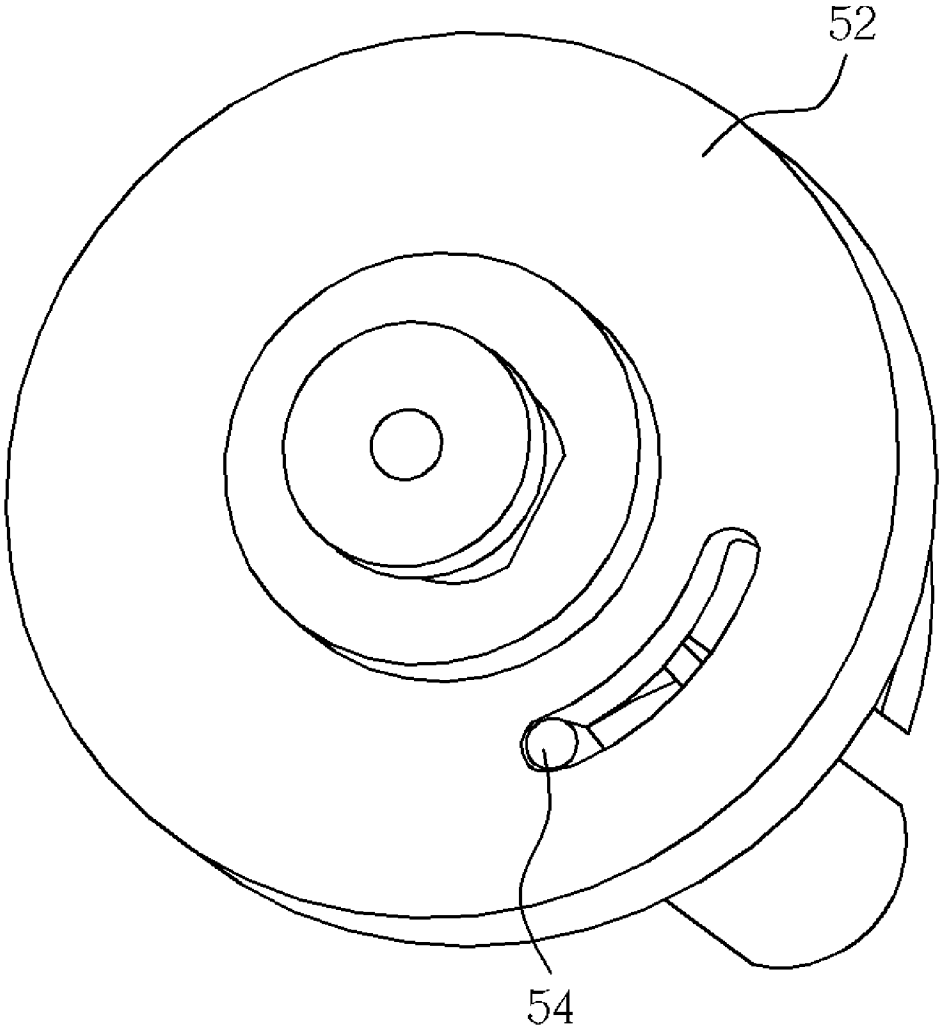
FIG. 5 illustrates an internal architecture diagram of a pump device.

Please refer to FIG. 3. FIG. 3 illustrates an internal architecture diagram of the printer 20. The printer 20 further comprises a feed roller 42, a feed gear 44 and a pump device 46. Please refer to FIG. 3, FIG. 4 and FIG. 5. FIG. 4 illustrates an outside view diagram of a pump device 46 of a printer 20. FIG. 5 illustrates an internal architecture diagram of a pump device 46. The pump device 46 comprises a pump gear 48; a pump holder 50; a pump plate 52, installed inside the pump holder 50; and a pump roller 54, installed inside the pump holder 50. The power source of the pump source of the pump device 46 is supplied by the feed roller 42, the feed roller 42 turns to drive the feed gear 44, as the feed gear 44 and the pump gear 48 are meshed together, when the feed gear 44 turns, it drives the pump gear 48, which in turn drives the pump plate 52 and the pump roller 54. Additionally, this action also compresses a tube of the pump holder 50 (not shown in the diagram), thus it is able to pump ink out of the covered nozzle of the first ink cartridge 22 and pump ink out of the nozzle of the second ink cartridge 24 which is coupled to the first cover 32 and the second cover 34 of the capping device 30.

Figure 6:
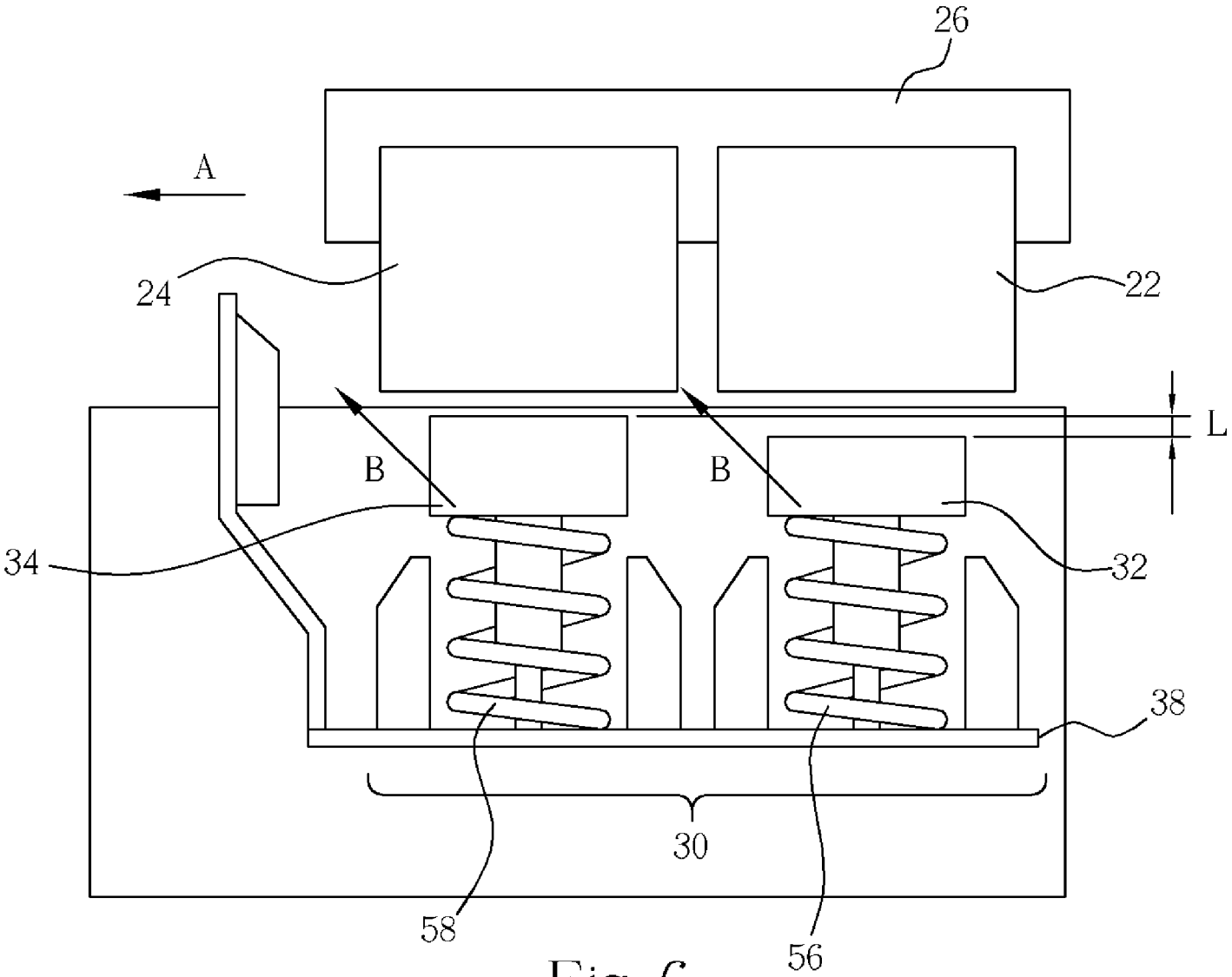
FIG. 6 illustrates a diagram of a capping device before covering a nozzle of an ink cartridge.
Figure 7:
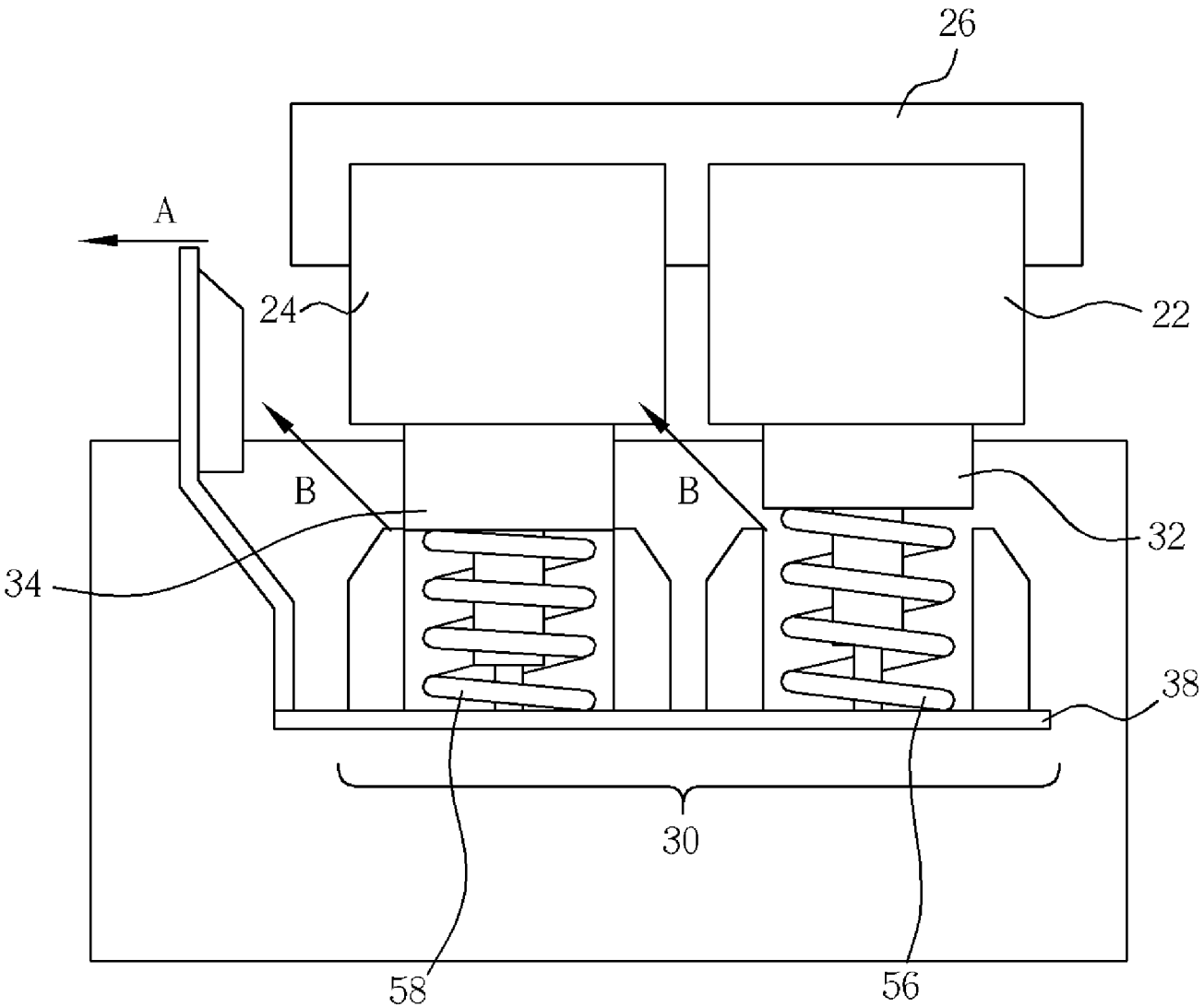
FIG. 7 illustrates a diagram of a capping device moving to a first position to cover a nozzle of an ink cartridge.
Figure 8:
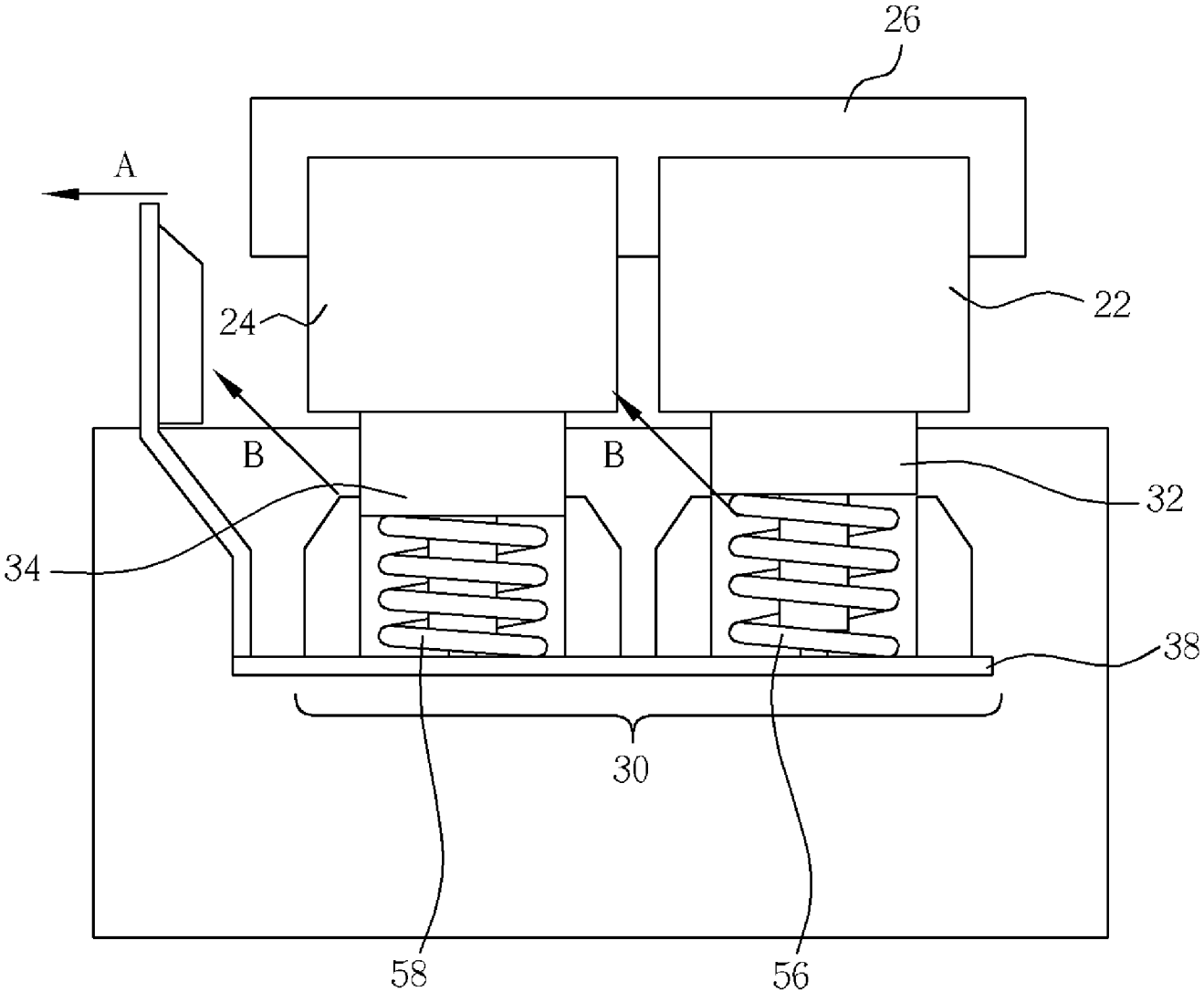
FIG. 8 illustrates a diagram of a capping device moving to a second position to cover a nozzle of an ink cartridge.

Please refer to FIG. 6, FIG. 7 and FIG. 8. FIG. 6 illustrates a diagram of the capping device 30 before covering the nozzle of the ink cartridge. FIG. 7 illustrates a diagram of the capping device 30 moving to a first position to cover the nozzle of the ink cartridge. FIG. 8 illustrates a diagram of the capping device 30 moving to a second position to cover the nozzle of the ink cartridge. The first cover 32 and the second cover 34 of the capping device 30 are coupled to a first elastic device 56 and a second elastic device 58 respectively. The first elastic device 56 and the second elastic device 58 can each be a spring. An end of the elastic device is coupled to the sled 38 for providing elasticity to the first cover 32 and the second cover 34. Before the second cover 34 covers the nozzle of the ink cartridge 24, a distance of the second cover 34 to the second ink cartridge 24 is less than the distance of the first cover 32 to the first ink cartridge, which means that the edge of the second cover 34 is higher than the edge of the first cover by a predetermined distance L and the predetermined distance can be 1mm. When the carriage of the ink cartridge is moving left as shown the direction arrow A in the FIG. 7 diagram, the capping device 30 will be driven upwards as shown in the direction arrow B in the diagram, the sled 38, the first cover 32 and the second cover 34 will be driven upwards as well. The first cover 32 and the second cover 34 will move upwards to cover the nozzle of the first ink cartridge 22 and the second ink cartridge 24 respectively. As the first ink cartridge 22, the second ink cartridge, the first cover 32 and the second cover 34 all move in one direction, there is no relative motion within the first ink cartridge 22, the second ink cartridge, the first cover 32 and the second cover 34.

A means can be installed inside the printer 20 (not shown in the diagram), for detecting the first ink cartridge 22 and the second ink cartridge 24. The means of the printer 20 is capable of controlling the carriage of the first ink cartridge 22 and the second ink cartridge 24 and the capping device to move to a first position shown in FIG. 7 when the means of the printer 20 detects the first ink cartridge 22 is an ink cartridge of substantial black ink such as a single black ink cartridge, and detects that the second ink cartridge 24 is an ink cartridge of substantial non-black ink such as a three-color ink cartridge of cyan, yellow and magenta. At this time, the first cover 32 and the second cover 34 of the capping device 30 cover the first ink cartridge 22 and the second cartridge 24 respectively, there is a height difference between the first cover 32 and the second cover 34, and the first cover 32 and the second cover 34 are coupled to the first elastic device 56 and the second elastic device 58 respectively, the compression change will be different as the change in the second elastic device 58 is greater than the change in the first elastic device 56. If the equivalent force constant of the first elastic device 56 and the second elastic device 58 are the same, according to the formula of Hooke's Law F=K*X (F: force exerted by the spring; K: force constant; X: displacement), a second force exerted by the second elastic device 58 to the second cover 34 is greater than a first force exerted by the first elastic device 56 to the first cover 32, a second pressure formed by the second force created by the second cover 34 and the nozzle of the covered second ink cartridge 24 is greater than a first pressure formed by the first force created by the first cover 32 and the nozzle of the covered first ink cartridge 22, which means that when the carriage 26 and the capping device 30 are moved to the first position shown in FIG. 7, pressure of vacuum space formed by the second cover 34 and the nozzle of the second ink cartridge 24 is greater than the pressure of vacuum space formed by the first cover 32 and the nozzle of the first ink cartridge 22. Whether or not the pump device 46 can pump ink out of the nozzle, one most important factor is the pressure of the vacuum space formed by the cover and the nozzle of the ink cartridge. If the pressure of the vacuum space formed is greater than critical pressure of the pump device 46 then the pump device 46 will begin pumping ink out of the nozzle of the ink cartridge. The pressure formed by the vacuum space is directly related to the force of the elastic device provided to the cover that is covering the ink cartridge and the greater the force provided, the greater the pressure will be formed by the vacuum space. The present invention can be configured such that, when the carriage 26 and the capping device 30 are moved to the first position as shown in FIG. 7, the second pressure formed by the second force created by the second cover 34 and the nozzle of the covered second ink cartridge 24 is greater than the critical pressure by the pump device 46 pumping ink out of the nozzle of the three color ink cartridge, and the first pressure formed by the first force created by the first cover 32 and the nozzle of the covered first ink cartridge 22 is less than the critical pressure by the pump device 46 pumping ink out of the nozzle of the black ink cartridge, which will result in the pump device 46 pumping ink out of the nozzle of the second ink cartridge 24 and not the ink out of the nozzle of the first ink cartridge 22.

When the means of the printer 20 detects the first ink cartridge 22 and the second ink cartridge 24 are substantial non-black ink cartridge (e.g., the first cartridge 22 is a three color ink cartridge of light cyan, light magenta and black, and the second cartridge 24 is a three color ink cartridge of cyan, yellow and magenta), the means of the printer 20 is capable of controlling the carriage 26 of the first ink cartridge 22 and the second ink cartridge 24 and the capping device 30 to move to a second position as shown in FIG. 8. The second position is the end position of the carriage 26 and the capping device 30 moving on the shaft and the first position shown in FIG. 7 is the previous position before the carriage 26 and the capping device move to the second position which means that the end position is a set predetermined position and the carriage 26 and the capping device 30 stopping at the second position on the sled 38 is closer to the shaft 28 than the first position. The first cover 32 and the second cover 34 of the capping device 30 are capable of covering the first ink cartridge 22 and the second ink cartridge 24 respectively, and the proximity of the first cover 32 to the second cover 34 covering the first ink cartridge 22 and the second ink cartridge 24 respectively at the second position is greater than the proximity of the first cover 32 to the second cover 34 covering the first ink cartridge 22 and the second ink cartridge 24 respectively at the first position. As the capping device moves in a diagonal upward motion, after the carriage 26 and the capping device 30 move to the first position as shown in FIG. 7, the carriage 26 will continue to move in a left motion and the capping device 30 will continue to move in the diagonal upward motion thus the first cover 32 and the second cover 34 cover the first ink cartridge 22 and the second ink cartridge 24 more tightly. As there is a difference in height between the first cover 32 and the second cover 34, in utilizing the same theory, the first cover 32 and the second cover 34 are coupled to the first elastic device 56 and the second elastic device 58 respectively, as the compression change of the first cover 32 and the second cover 34 covering the first ink cartridge 22 and the second ink cartridge 24 will be different as the change in the second elastic device 58 is greater than the change in the first elastic device 56. At the second position, a fourth force exerted by the second elastic device 58 to the second cover 34 is greater than a third force exerted by the first elastic device 56 to the first cover 32; furthermore, as the compression change of the first elastic device 56 and the second elastic device 58 at the second position is greater than the compression change at the first position, the fourth force exerted by the second elastic device 58 to the second cover 34 at the second position is greater than the second force exerted by the second elastic device 58 to the second cover 34 at the first position, and the third force exerted by the first elastic device 56 to the first cover 32 at the second position is greater than the first force exerted by the first elastic device 56 to the first cover 32 at the first position. Under the same theory, a fourth pressure formed by the fourth force created by the second cover 34 and the nozzle of the covered second ink cartridge 24 at the second position is greater than a third pressure formed by the third force created by the first cover 32 and the nozzle of the covered first ink cartridge 22, the fourth pressure is greater than the second pressure and the third pressure is greater than the first pressure. The present invention can be configured such that, when the carriage 26 and the capping device 30 are moved to the second position as shown in FIG. 8, the fourth pressure formed by the fourth force created by the second cover 34 and the nozzle of the covered second ink cartridge 24 is greater than the critical pressure of the pump device 46 pumping ink out of the nozzle of the three color ink cartridge, and the third pressure formed by the third force created by the first cover 32 and the nozzle of the covered first ink cartridge 22 is greater than the critical pressure of the pump device 46 pumping ink out of the nozzle of the three color ink cartridge, as a result the pump device 46 will pump ink out of the nozzle of the first ink cartridge 22 and the second ink cartridge 24.

In conclusion, the present invention can be configured such that, when the first ink cartridge is a cartridge of substantial black ink, the carriage 26 and the capping device 30 are moved to the first position as shown in FIG. 7 to utilize the height difference of the first cover 32 and the second cover 34, the pump device will then pump ink out of the nozzle of the second ink cartridge 24 but not pump ink out of the nozzle of the first ink cartridge 22, and the function of not pumping black ink is performed; when the first ink cartridge is an cartridge of substantial non-black ink, the carriage 26 and the capping device 30 then move to the second position as shown in FIG. 8, as the compression change volume of the first elastic device 56 and the second elastic device 58 is greater at the second position, the pressure of the vacuum space formed by the force exerted on the cover and the ink cartridge is greater at the second position, hence the pump device is able to pump ink out of the nozzle of the first ink cartridge 22 and the second ink cartridge 24.

The present invention is able to utilize the carriage 26 to carry the first ink cartridge 22 and not the second ink cartridge 24. The printer 20 is capable of selectively controlling the first cover 32 to cover the nozzle of the first ink cartridge 22 at the first position or the first cover 32 to cover the nozzle of the first ink cartridge at the second position, which means that when the means of the printer 20 detects the first ink cartridge 22 is an ink cartridge of substantial non-black ink, the means then controls the carriage 26 and the capping device 30 to move to the second position as shown in FIG. 8, and when the first ink cartridge is a cartridge of substantial black ink, the means controls the carriage 26 and the capping device 30 to move to the first position as shown in FIG. 7. As the compression change volume of the first elastic device 56 and the second elastic device 58 is greater at the second position, the pressure of the vacuum space formed by the force exerted on the cover and the ink cartridge is also greater at the second position, hence the pump device is able to pump ink out of the nozzle of the first ink cartridge 22 at the second position and not the first position. Therefore the function of pumping only color ink and not black ink is performed.

Figure 9:
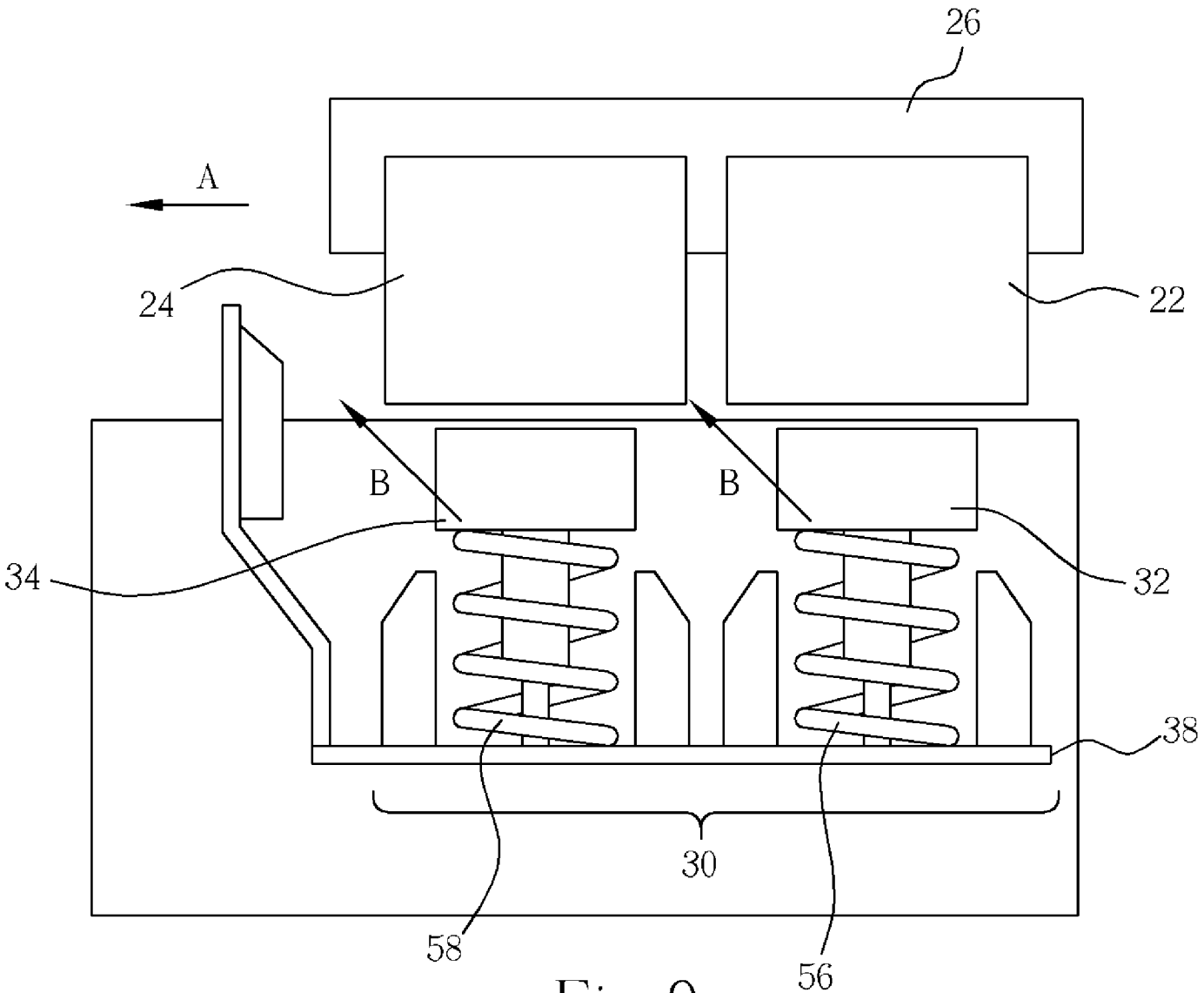
FIG. 9 illustrates a diagram of a capping device before covering a nozzle of an ink cartridge according to the second embodiment.
Figure 10:
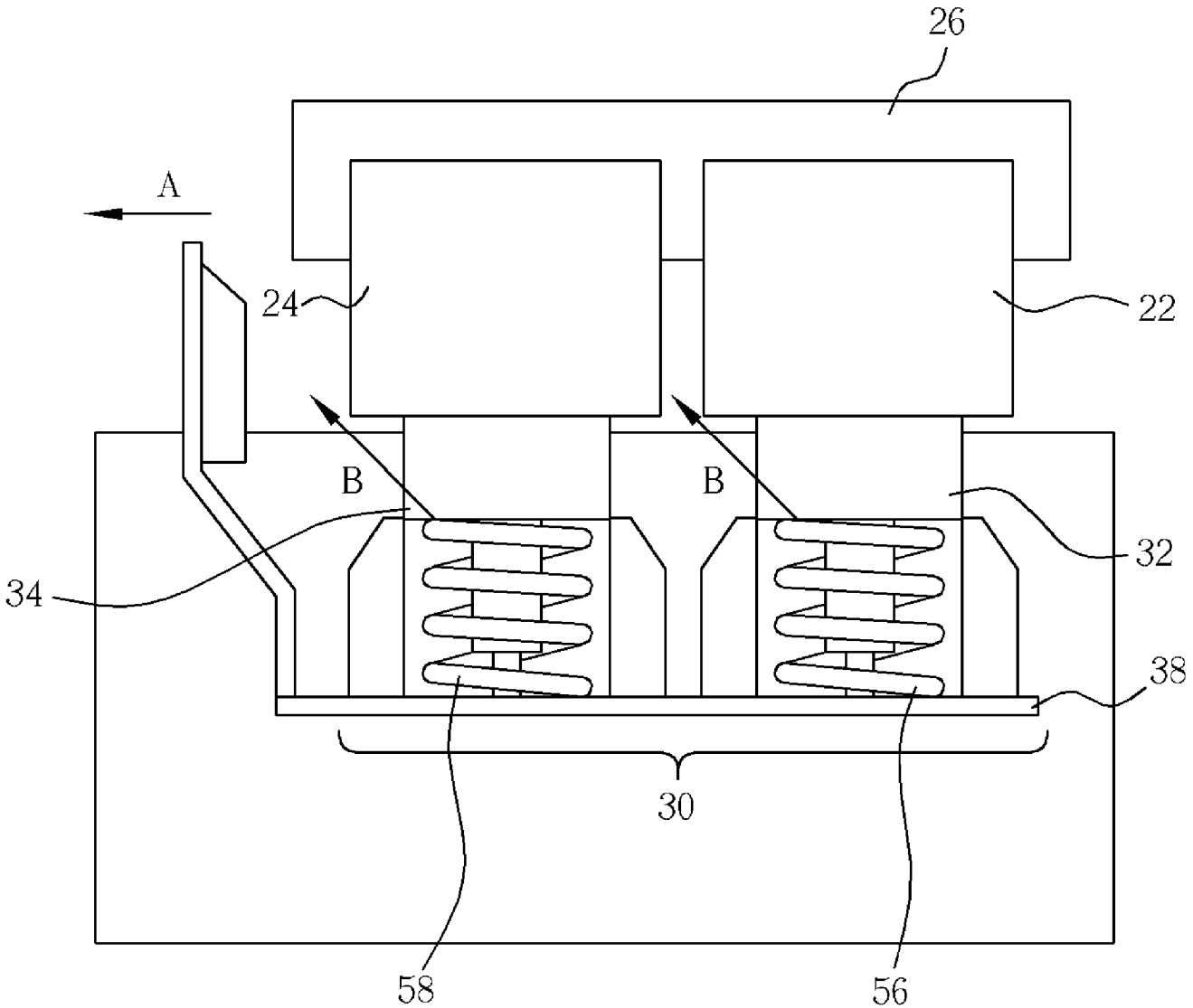
FIG. 10 illustrates a diagram of a capping device moving to a first position to cover a nozzle of an ink cartridge according to the second embodiment
Figure 11:
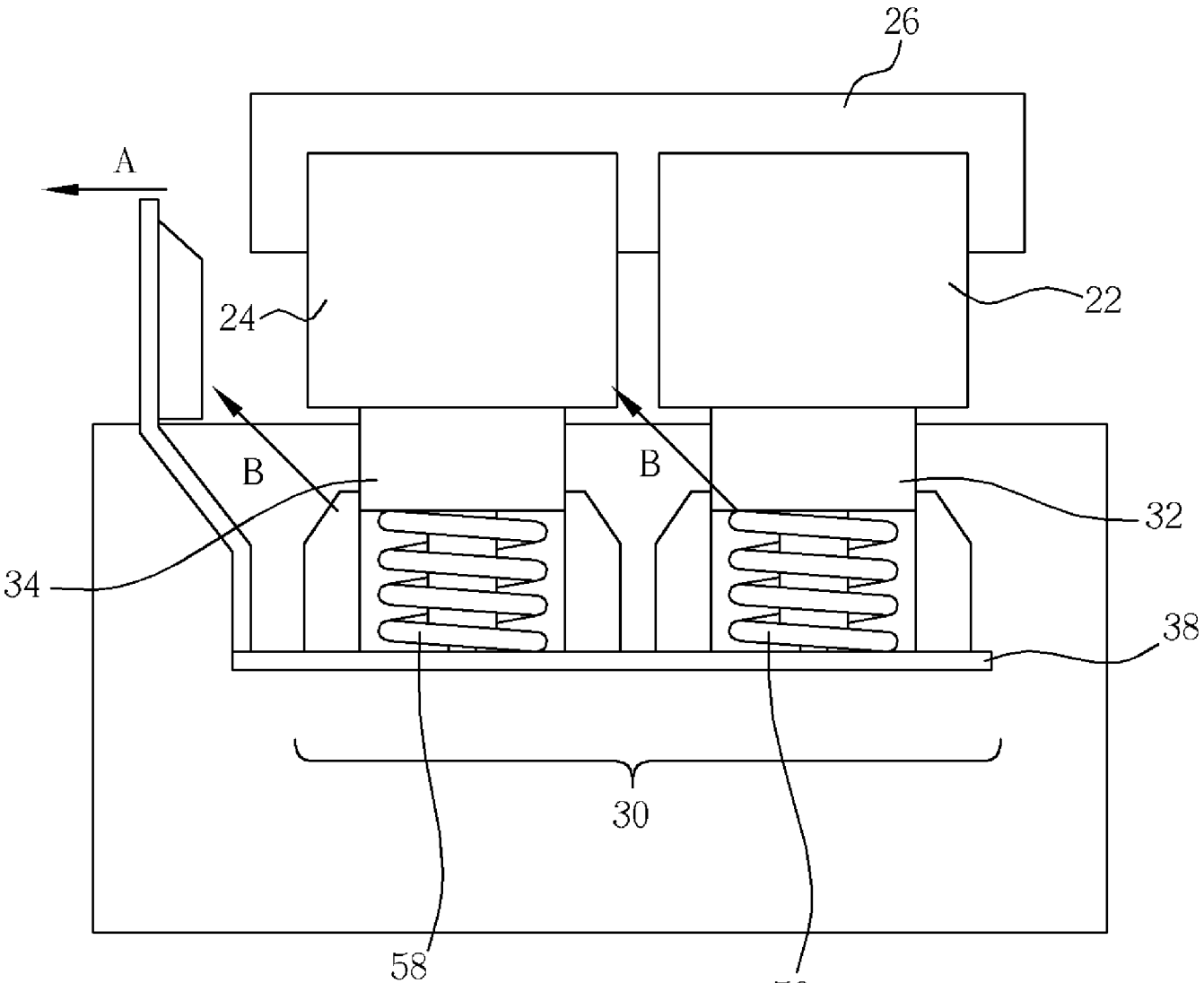
FIG. 11 illustrates a diagram of a capping device of the first embodiment moving to a second position to cover a nozzle of an ink cartridge.

The present invention can also utilize the design of the difference in the equivalent force constant of the elastic device to selectively control pumping color ink. Please refer to FIG. 9, FIG. 10 and FIG. 11. FIG. 9 illustrates a diagram of a capping device 30 before covering the nozzle of the ink cartridge according to the second embodiment. FIG. 10 illustrates a diagram of the capping device 30 moving to a first position to cover the nozzle of the ink cartridge according to the second embodiment. FIG. 11 illustrates a diagram of a capping device 30 of the first embodiment moving to a second position to cover a nozzle of an ink cartridge. Similar to the embodiment mentioned above, the first cover 32 and the second cover 34 of the capping device 30 are coupled to the first elastic device 56 and the second elastic device 58 respectively. The first elastic device 56 and the second elastic device 58, each can be a spring, for providing elasticity to the first cover 32 and the second cover 34, but the difference is that the equivalent force constant of the first elastic device 56 is less than the equivalent force constant of the second elastic device 58 and the height of the first cover 32 and the second cover 34 are identical.

When the means of the printer 20 detects the first ink cartridge 22 is a substantial black ink cartridge, for example a single black ink cartridge, and the second ink cartridge is a substantial non-black ink cartridge, for example a three color ink cartridge of light cyan, light magenta and black. The means of the printer 20 is capable of controlling the carriage 26 of the first ink cartridge 22 and the second ink cartridge 24 and the capping device 30 to move to the first position as shown in FIG. 10, the first cover 32 and the second cover 34 of the capping device 30 is capable of covering the first ink cartridge 22 and the second ink cartridge 24 respectively, as there is no height difference between the first cover 32 and the second cover 34, the first cover 32 and the second cover 34 are coupled to the first elastic device 56 and the second elastic device 58 respectively, as the compression change of the first cover 32 and the second cover 34 covering the first ink cartridge 22 and the second ink cartridge 24 is the same, the equivalent force constant of the second elastic device 58 is greater than the first elastic device 56, according to the formula of Hooke's Law F=K*X (F: force exerted by the spring; K: force constant; X: displacement), the second force exerted by the second elastic device 58 to the second cover 34 is greater than the first force exerted by the first elastic device 56 to the first cover 32, the second pressure formed by the second force created by the second cover 34 and the nozzle of the covered second ink cartridge 24 is greater than the first pressure formed by the first force created by the first cover 32 and the nozzle of the covered first ink cartridge 22, which means that when the carriage 26 and the capping device 30 are moved to the first position shown in FIG. 10, the pressure of vacuum space formed by the second cover 34 and the nozzle of the second ink cartridge 24 is greater than the pressure of vacuum space formed by the first cover 32 and the nozzle of the first ink cartridge 22. The present invention can be configured such that, when the carriage 26 and the capping device 30 are moved to the first position as shown in FIG. 10, the second pressure formed by the second force created by the second cover 34 and the nozzle of the covered second ink cartridge 24 is greater than the critical pressure by the pump device 46 pumping ink out of the nozzle of the three color ink cartridge, and the first pressure formed by the first force created by the first cover 32 and the nozzle of the covered first ink cartridge 22 is less than the critical pressure by the pump device 46 pumping ink out of the nozzle of the black ink cartridge, the pump device 46 will pump ink out of the nozzle of the second ink cartridge 24 and not the ink out of the nozzle of the first ink cartridge 22.

When the means of the printer 20 detects the first ink cartridge 22 and the second ink cartridge 24 are substantial non-black ink cartridge, for example the first cartridge 22 is a three color ink cartridge of light cyan, light magenta and black, and the second cartridge 24 is a three color ink cartridge of cyan, yellow and magenta, the means of the printer 20 is capable of controlling the carriage 26 of the first ink cartridge 22 and the second ink cartridge 24 and the capping device 30 to move to a second position as shown in FIG. 11. The second position is the end position of the carriage 26 and the capping device 30 moving on the shaft and the first position shown in FIG. 10 is the previous position before the carriage 26 and the capping device move to the second position which means that the end position is a predetermined position set. The first cover 32 and the second cover 34 of the capping device 30 are capable of covering the first ink cartridge 22 and the second ink cartridge 24 respectively, and the proximity of the first cover 32 and the second cover 34 covering the first ink cartridge 22 to the second ink cartridge 24 respectively at the second position is greater than the proximity of the first cover 32 and the second cover 34 covering the first ink cartridge 22 to the second ink cartridge 24 respectively at the first position. As the capping device moves in a diagonal upward motion, after the carriage 26 and the capping device 30 move to the first position as shown in FIG. 10, the carriage 26 will continue to move in a left motion and the capping device 30 will continue to move in the diagonal upward motion, in this way the first cover 32 and the second cover 34 will cover the first ink cartridge 22 and the second ink cartridge 24 more tightly. As the equivalent force constant of the second elastic device 58 is greater than the first elastic device 56, the fourth force exerted by the second elastic device 58 to the second cover 34 is greater than the third force exerted by the first elastic device 56 to the first cover 32 at the second position; furthermore, the compression change of the first elastic device 56 and the second elastic device 58 at the second position is greater than at the first position, the fourth force exerted by the second elastic device 58 to the second cover 34 at the second position is greater than the second force exerted by the second elastic device 58 to the second cover 34 at the first position, and the third force exerted by the first elastic device 56 to the first cover 32 at the second position is greater than the first force exerted by the first elastic device 56 to the first cover 32 at the first position. Also at the second position, the fourth pressure formed by the fourth force created by the second cover 34 and the nozzle of the covered second ink cartridge 24 is greater than the third pressure formed by the third force created by the first cover 32 and the nozzle of the covered first ink cartridge 22, therefore the fourth pressure is greater than the second pressure and the third pressure is greater than the first pressure. The present invention can configured such that, when the carriage 26 and the capping device 30 are moved to the second position as shown in FIG. 11, the fourth pressure formed by the fourth force created by the second cover 34 and the nozzle of the covered second ink cartridge 24 is greater than the critical pressure by the pump device 46 pumping ink out of the nozzle of the three color ink cartridge, and the third pressure formed by the third force created by the first cover 32 and the nozzle of the covered first ink cartridge 22 is greater than the critical pressure by the pump device 46 pumping ink out of the nozzle of the three color ink cartridge, hence the pump device 46 will pump ink out of the nozzle of the first ink cartridge 22 and the second ink cartridge 24.

In conclusion of the above-mentioned, the second embodiment of the present invention can be configured such that, when the first ink cartridge is an cartridge of substantial black ink, the carriage 26 and the capping device 30 are moved to the first position as shown in FIG. 10 to utilize the design of the equivalent force constant difference of the second elastic device 58 greater than the first elastic device 56, the pump device will then pump ink out of the nozzle of the second ink cartridge 24 and not pump ink out of the nozzle of the first ink cartridge 22, and the function of not pumping black ink is performed; when the first ink cartridge is an cartridge of substantial non-black ink, the carriage 26 and the capping device 30 are then moved to the second position as shown in FIG. 11. The compression change volume of the first elastic device 56 and the second elastic device 58 is greater at the second position and the pressure of the vacuum space formed by the force exerted on the cover and the ink cartridge is greater at the second position. As a result, the pump device is able to pump ink out of the nozzle of the first ink cartridge 22 and the second ink cartridge 24.

Integration of the first embodiment and the second embodiment of the present invention, provides the present invention with the additional capable of also being able to utilizing the design of the height difference between the first cover 32 and the second cover 34 together with the design of the equivalent force constant difference of the second elastic device 58 greater than the first elastic device 56 at the same time. The function of selecting pumping only color ink can be achieved. The operational theory is similar to the embodiments mentioned above; therefore it will not be further mentioned.

In comparison with the prior art, the present invention is a printer capable of controlling position of covering a nozzle of an ink cartridge to determine whether or not to pump ink out of the nozzle of the ink cartridge and a function of selecting pumping only color ink and not black ink. The present invention overcomes the defect of the pump mechanism of the conventional printer as black ink is pumped by the pump mechanism that causes the black ink to dry up in the tube of the pump mechanism. Hence the quality of an image printout will be improved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A printer capable of controlling position of a nozzle of an ink cartridge, the printer comprising:

a housing;

a shaft, installed in the housing;

a carriage, installed on the shaft in a sliding manner, for carrying a first ink cartridge;

a first cover for covering a nozzle of the first ink cartridge; and a means for determining a type of the first ink cartridge and controlling a stopping position of the carriage and the first cover as the first cover covers the nozzle of the first ink cartridge according to the type of the first ink cartridge.

2. The printer of claim 1 further comprising:

a pump device, coupled to the first cover, for pumping ink out of the nozzle of the first ink cartridge.

3. The printer of claim 1 wherein the carriage is utilized for carrying the first ink cartridge and a second ink cartridge, the printer further comprising a second cover for covering the nozzle of the second ink cartridge.

4. The printer of claim 3 further comprising:

a pump device, coupled to the first cover and the second cover, for pumping ink out of the nozzle of the first ink cartridge and out of the nozzle of the second ink cartridge.

5. The printer of claim 3 wherein before the second cover covers the nozzle of the second ink cartridge, a distance between the second cover and the second ink cartridge is less than a distance between the first cover and the first ink cartridge.

6. The printer of claim 1 wherein the means is utilized for controlling a movement of the carriage and the first cover to stop at a first position when the first ink cartridge is an ink cartridge of substantial black ink, and the means is further utilized for controlling the movement of the carriage and the first cover to stop at a second position when the first ink cartridge is an ink cartridge of substantial non-black ink, a proximity of the first cover at the second position to the first ink cartridge is greater than a proximity of the first cover at the first position to the first ink cartridge.

7. The printer of claim 1 further comprising:

a first elastic device having a first end coupled to the first cover for pushing the first cover to cover the nozzle of the first ink cartridge.

8. The printer of claim 7 wherein a second end of the first elastic device is coupled to a sled.

9. The printer of claim 8 wherein the means is utilized for controlling a movement of the carriage and the first cover to stop at an opposite end of the sled which is closer to the position of the shaft when the first ink cartridge is an ink cartridge of substantial non-black ink, and the means is further utilized for controlling the movement of the carriage and the first cover to stop at the opposite end of the sled which is further away from the position of the shaft when the first ink cartridge is an ink cartridge of substantial black ink.

10. The printer of claim 7 wherein the first elastic device is a spring.

11. The printer of claim 7 wherein the carriage is utilized for carrying the first ink cartridge and a second ink cartridge, the printer further comprising a second cover for covering the nozzle of the second ink cartridge, and a second elastic device, a first end of the second elastic device is coupled to the second cover, for pushing the second cover such that the second cover covers the nozzle of the second ink cartridge.

12. The printer of claim 11 wherein equivalent elasticity of the first elastic device is less than the equivalent elasticity of the second elastic device.

13. The printer of claim 11 wherein before the second cover covers the nozzle of the second ink cartridge, distance of the second cover to the second ink cartridge is less than the distance of the first cover to the first ink cartridge.

14. The printer of claim 11 wherein the first elastic device and the second elastic device each is a spring respectively.

15. A method of controlling position of covering a nozzle of ink cartridge, the method comprising:

determining type of a first ink cartridge; and controlling stopping position of the carriage of the first ink cartridge and the first cover as the first cover covers the nozzle of the first ink cartridge according to the type of the first ink cartridge.

16. The method of claim 15 further comprising:

pumping ink out of the nozzle of the first ink cartridge.

17. The method of claim 15 further comprising:

controlling the movement of the carriage and the first cover to stop at a first position when the first ink cartridge is determined to be an ink cartridge of substantial black ink, and controlling the movement of the carriage and the movement of the first cover to stop at a second position when the first ink cartridge is determined to be an ink cartridge of substantial non-black ink, proximity of the first cover at the second position to the first ink cartridge is greater than the proximity of the first cover at the first position to the first ink cartridge.

18. The method of claim 17 wherein the method controls the movement of the carriage and the movement of the first cover to stop at the second position when the first ink cartridge is determined to be an ink cartridge of substantial non-black ink and utilizes a pump device to pump ink out of the nozzle of the first ink cartridge, and the method controls the movement of the carriage and the movement of the first cover to stop at the first position when the first ink cartridge is determined to be an ink cartridge of substantial black ink and the pump device cannot pump ink out of the nozzle of the first ink cartridge.

19. The method of claim 18 further comprising:

controlling a second cover for covering a nozzle of a second ink cartridge, and controlling the movement of the carriage and the movement of the first cover to stop at the second position when the first ink cartridge is determined to be an ink cartridge of substantial non-black ink and utilizing the pump device to pump ink out of the nozzle of the first ink cartridge and the second ink cartridge, and the method controls the movement of the carriage and the movement of the first cover to stop at the first position when the first ink cartridge is determined to be an ink cartridge of substantial black ink and utilizes the pump device to pump ink out of the nozzle of the second ink cartridge and at this time the pump device cannot pump ink out of the nozzle of the first ink cartridge.

20. The method of claim 19 wherein before the second cover covers the nozzle of the second ink cartridge, distance of the second cover to the second ink cartridge is less than the distance of the first cover to the first ink cartridge.

21. The method of claim 19 further comprising:

installing a first elastic device under the first cover, and installing a second elastic device under the second cover, equivalent elasticity of the first elastic device is less than the equivalent elasticity of the second elastic device.

* * * * *